US009433848B2

(12) United States Patent
Awad

(10) Patent No.: US 9,433,848 B2
(45) **Date of Patent: *Sep. 6, 2016**

(54) GOLF PUTTING AND CHIPPING TRAINING AID

(71) Applicant: Roger Emerald Awad, Windsor, CA (US)

(72) Inventor: Roger Emerald Awad, Windsor, CA (US)

(73) Assignee: Roger Emerald Awad, Windsor ON (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,470

(22) Filed: Mar. 14, 2016

(65) Prior Publication Data

US 2016/0193519 A1 Jul. 7, 2016

Related U.S. Application Data

(63) Continuation-in-part of application No. 14/559,670, filed on Dec. 3, 2014, now Pat. No. 9,320,959.

(51) Int. Cl.
*A63B 69/36* (2006.01)
*A63B 69/00* (2006.01)

(52) U.S. Cl.
CPC ..... *A63B 69/3685* (2013.01); *A63B 69/0059* (2013.01); *A63B 69/36* (2013.01); *A63B 69/3608* (2013.01); *A63B 69/3676* (2013.01); *A63B 2208/0204* (2013.01)

(58) Field of Classification Search
USPC ..... 473/206, 208, 212, 213, 214, 215, 257, 473/274, 276, 409
See application file for complete search history.

(56) References Cited

U.S. PATENT DOCUMENTS

| | | | | |
|---|---|---|---|---|
| 4,662,640 A * | 5/1987 | Grander | A63B 21/0552 473/215 |
| 5,149,099 A * | 9/1992 | Radakovich | A63B 69/0059 473/208 |
| 5,688,184 A * | 11/1997 | Johnson | A63B 69/3608 473/208 |
| 5,795,238 A * | 8/1998 | Nicholson | A63B 69/0059 473/213 |
| 5,893,803 A * | 4/1999 | Leadbetter | A63B 69/0059 473/206 |
| 6,994,633 B2 * | 2/2006 | Czaja | A63B 69/0059 473/219 |

* cited by examiner

*Primary Examiner* — Nini Legesse

(57) ABSTRACT

Disclosed herein is a golfing aid that includes a club holder for realisably holding a golf club shaft, and a flexible shoulder strap coupled to a club holder. The flexible shoulder strap is sized and shaped to loop over the shoulders of a golfer and press against upper arms of the golfer. The shoulder strap includes arm engaging portions for engaging outer sides of the upper arms. The golfing aid includes strap adjustment cam locking mechanisms coupled to the club holder for clamping and adjusting strap length to accommodate various size golfers. The training aid produces the perfect one piece connected triangular pendulum putting/chipping motion of the shoulders, arms, hands and club. There is no movement of the club shaft relative to the hands and arms. The training aid provides immediate feedback if the golfer is not using their shoulders to perform the correct putting or chipping stroke.

4 Claims, 16 Drawing Sheets

GOLF PUTTING AND CHIPPING TRAINING AID

TECHNICAL FIELD

The disclosure herein relates to golfing aids, and in particular to golfing aids for training putting and chipping strokes.

BACKGROUND

Developing a reliable golf stroke can be a difficult task for both amateur and professional golfers. One of the keys to teaching a good golf stroke is maintaining consistent body alignment throughout the stroke. However, it can take years of practice to cultivate a consistent technique that is imprinted to muscle memory. To overcome this difficulty, some golfing aids have been developed to help golfers train and develop consistent golf strokes.

For example, U.S. Pat. No. 5,149,099 (Radakovich) discloses a device for facilitating correct swinging of a golf club. The device comprises an elastic loop which is donned over the head of the player with the major portion of the loop resting over the chest, abdomen and on top of the shoulders. The rear of the loop is affixed to the body of the player so that the loop is disposed away from the neck, approximately at the height of the third vertebrae of the back (spine). In play, the handle end of the club is laid inside the elastic loop and pushed downward and outward by the left hand and arm stretching the elastic loop as much as possible. According to Radakovich, swinging the golf club against the upward pull exerted by the elastic loop produces the surprising effect of improved control of the golfer's arms which allegedly results in a nearly perfect swing plane and leveling and squaring up of the golf club face.

U.S. Pat. No. 5,688,184 (Johnson) discloses a golf swing training device that includes a grip, an elastic cord loop, a neck pad, and an adjustment mechanism. The grip is a conventional golf club grip. The elastic cord loop is secured at the narrow end of grip. The adjustment mechanism allows the length of cord loop to be selectively adjusted for a particular golfer. The neck pad includes straps, through which the elastic cord loop is inserted. The neck pad can also double as a carrying case for the grip and cord loop. The neck pad includes a sleeve closed at one end by a flap. Johnson also disclosed a method of improving a golfer's swing, comprising the steps of: gripping the grip; extending the elastic cord loop around a golfer's neck; attaching the ends of the cord loop to one end of the grip; holding the grip at an address position, with the elastic cord loop attached at the lower end of the grip, and with the elastic cord loop having sufficient tension to resist further movement of the lower end of the grip away from the golfer's head; and simulating the portion of a golf swing before and after impact where the wrists of the golfer release, in a manner that the elastic cord loop retains tension throughout the swing.

U.S. Pat. No. 5,893,803 (Leadbetter et al.) discloses a golf training device for training a golfer to execute a putting stroke. The device includes a neck engaging member, a longitudinal strap having a first end attached to the neck engaging member and a free end. The strap includes a weighted ring which causes the strap to hang downwardly in a vertical direction when the neck engaging member is placed around the neck of a golfer and used during the execution of a putting stroke. According to Leadbetter et al., in use, a golfer grasps the strap holding it firmly against a handle of a golf club thereby fixing the distance between the hands and his shoulders, neck and head, which allegedly ensures a repetitive consistent putting stroke.

In spite of these known devices, there is a need for an improved golfing aid for training putting and chipping strokes.

SUMMARY

According to one aspect, there is provided a golfing aid that includes a club holder for releasably holding a golf club shaft, and a flexible shoulder strap coupled to the club holder. The flexible shoulder strap is sized and shaped to loop behind shoulders of a golfer and press against upper arms of the golfer. The flexible shoulder strap includes arm engaging portions for engaging outer sides of the upper arms. The golfing aid also includes a strap adjustment mechanism coupled to the flexible shoulder strap for adjusting strap length.

Each arm engaging portion may have an arm engaging length and an arm engaging width that substantially covers most of the upper arm. The arm engaging width may be at least 2-inches. The arm engaging length may be at least 8-inches. The arm engaging portions may be separated by an intermediate back engaging portion, and the flexible shoulder strap may have a constant width along the arm engaging portions and the intermediate back engaging portion so as to extend across both left and right upper arms of the golfer.

The flexible shoulder strap may have a minimum strap length of at least 40-inches and may be extendable to a maximum strap length of at least 120-inches.

The flexible shoulder strap may be made from an inextensible material.

The flexible shoulder strap may have an inwardly facing textured surface for engaging the shoulders of the golfer.

The club holder may include a base and two club gripping arms extending outwardly from the base so as to form a club receiving channel for receiving the golf club shaft there between. The club holder may be made of a resilient material that biases the club gripping arms inwardly towards each other.

The strap adjustment mechanism may include at least one quick release buckle. In some embodiments, the quick release buckle may include a ladder strap coupled to the flexible shoulder strap, and a ratcheting buckle for releasable engaging the ladder strap. In some embodiments, the quick release buckle may include a cam lock buckle for releasable engaging an adjustable portion of the flexible shoulder strap.

The strap adjustment mechanism may be pivotally coupled to at least one of the shoulder strap and the club holder.

According to another aspect, there is provided a method of training a golf stroke. The method includes: inserting a golf club shaft within a club holder, the club holder being coupled to a flexible shoulder strap via a strap adjustment mechanism; placing the flexible shoulder strap around shoulders and upper arms of a golfer, the flexible shoulder strap including arm engaging portions for engaging the upper arms; gripping the golf club shaft; setting a strap length by adjusting the strap adjustment mechanism so that the flexible shoulder strap is pulled taut against the shoulders while grasping the golf club shaft; and swinging the golf club shaft while the shoulder strap remains taut and presses against the shoulder and the upper arms.

Other aspects and features will become apparent, to those ordinarily skilled in the art, upon review of the following description of some exemplary embodiments.

BRIEF DESCRIPTION OF THE DRAWINGS

Some embodiments of the present specification will now be described, by way of example only, with reference to the following drawings, in which.

DETAILED DESCRIPTION

Figure 1:
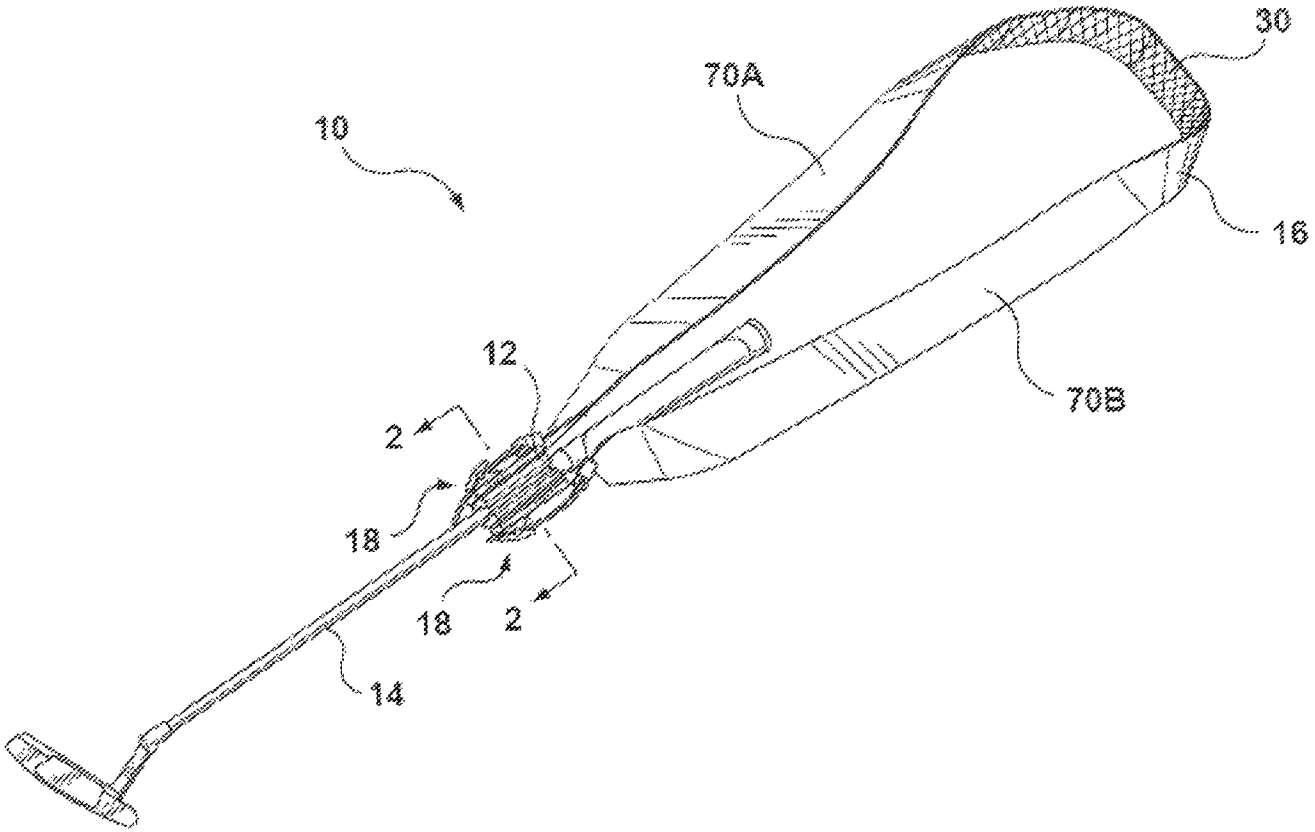
FIG. 1 is a perspective view of a golfing aid including a club holder secured to a golf club shaft, a flexible shoulder strap, and a strap adjustment mechanism, in accordance with one embodiment.

Referring to FIG. 1, illustrated therein is a golfing aid 10 for assisting a golfer with training a golf stroke such as a putting or chipping stroke. The golfing aid 10 includes a club holder 12 for releasably holding a golf club shaft 14, a flexible shoulder strap 16 coupled to the club holder 12 for being looped around shoulders and upper arms of a golfer, and one or more strap adjustment mechanisms 18 coupled to the flexible shoulder strap 16 for adjusting strap length.

Figure 2:
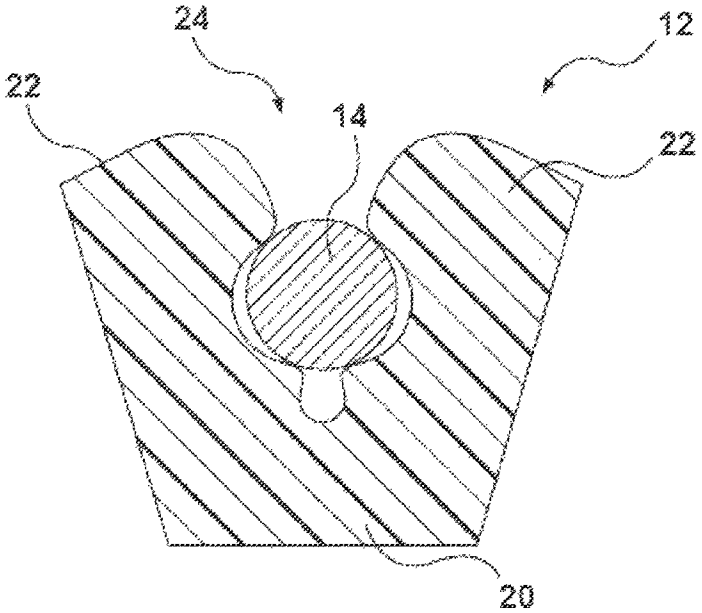
FIG. 2 is a cross-sectional view of the club holder along line 2-2 of FIG. 1.

Referring to FIG. 2, the club holder 12 is configured to releasably hold or otherwise engage the golf club shaft 14. The golf club shaft 14 may be the shaft of a putter, a wedge, iron, or another golf club. The club holder 12 could also be used with another object similar to a golf club shaft such as a stick or elongate rod, which may or may not be included with the golfing aid 10.

As shown, the club holder 12 includes a base 20 and two club gripping arms 22 extending outwardly from the base 20 so as to form a club receiving channel 24 for receiving the golf club shaft 14, stick, or another object similar to a golf club. The golf club shaft 14 may be inserted into the receiving channel 24 by pulling apart the club gripping arms 22. In some embodiments, the club holder 12 may be made of rubber or another resilient material that biases the club gripping arms 22 inwardly towards each other. This may help secure the golf club shaft 14 within the club receiving channel 24.

In some embodiments, the club holder 12 may have other configurations. For example, the club holder 12 may have a one-piece construction, or a multi-piece construction. More specifically, in some embodiments the club holder 12 may include a two-piece clamping block that can be clamped around a golf club shaft by screwing two clamp portions together.

The flexible shoulder strap 16 is generally made from an inextensible or inelastic material. For example, the flexible shoulder strap 16 may be made from rubberized nylon or another woven or non-woven fabric that is flexible yet resistant to stretching.

Referring again to FIG. 1, the flexible shoulder strap 16 may have an inwardly facing textured surface 30 for engaging shoulders of the golfer. This textured surface 30 may help to position the flexible shoulder strap 16 on the back shoulders of the golfer and may also keep the flexible shoulder strap 16 in place during a swing.

Figure 3:
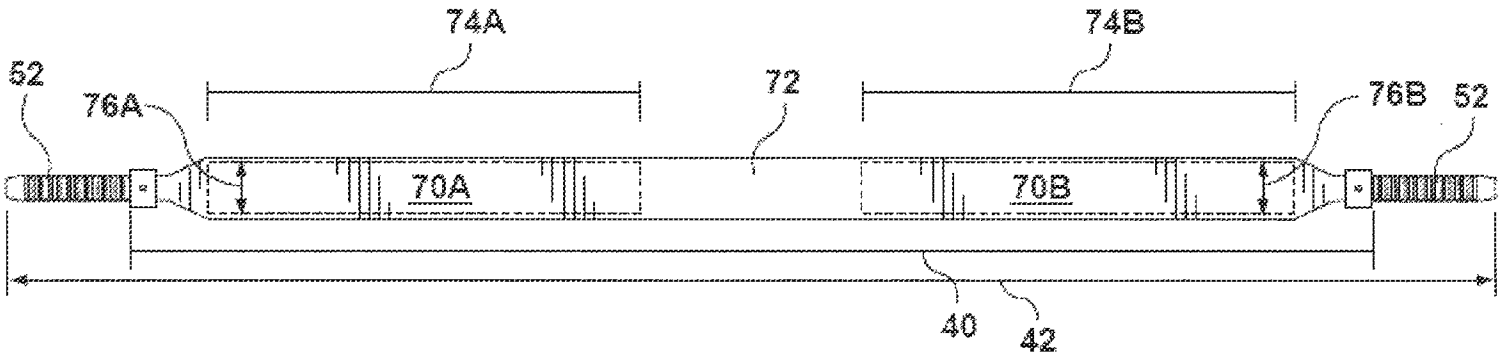
FIG. 3 is a top plan view of the flexible shoulder strap.

Referring to FIG. 3, the flexible shoulder strap 16 is sized and shaped to be looped around the shoulders of a golfer. For example, the flexible shoulder strap 16 may have a minimum strap length 40 and may be extendable to a maximum strap length 42. In some embodiments, the minimum strap length 40 may be at least 40-inches, and the maximum strap length 42 may be at least 120-inches. More particularly, the minimum strap length 40 may be about 80-inches, and the maximum strap length may be about 120-inches. In other embodiments, the minimum and maximum strap lengths 40, 42 may be longer or shorter (e.g. to accommodate golfers of different age groups or body sizes).

Figure 4A:
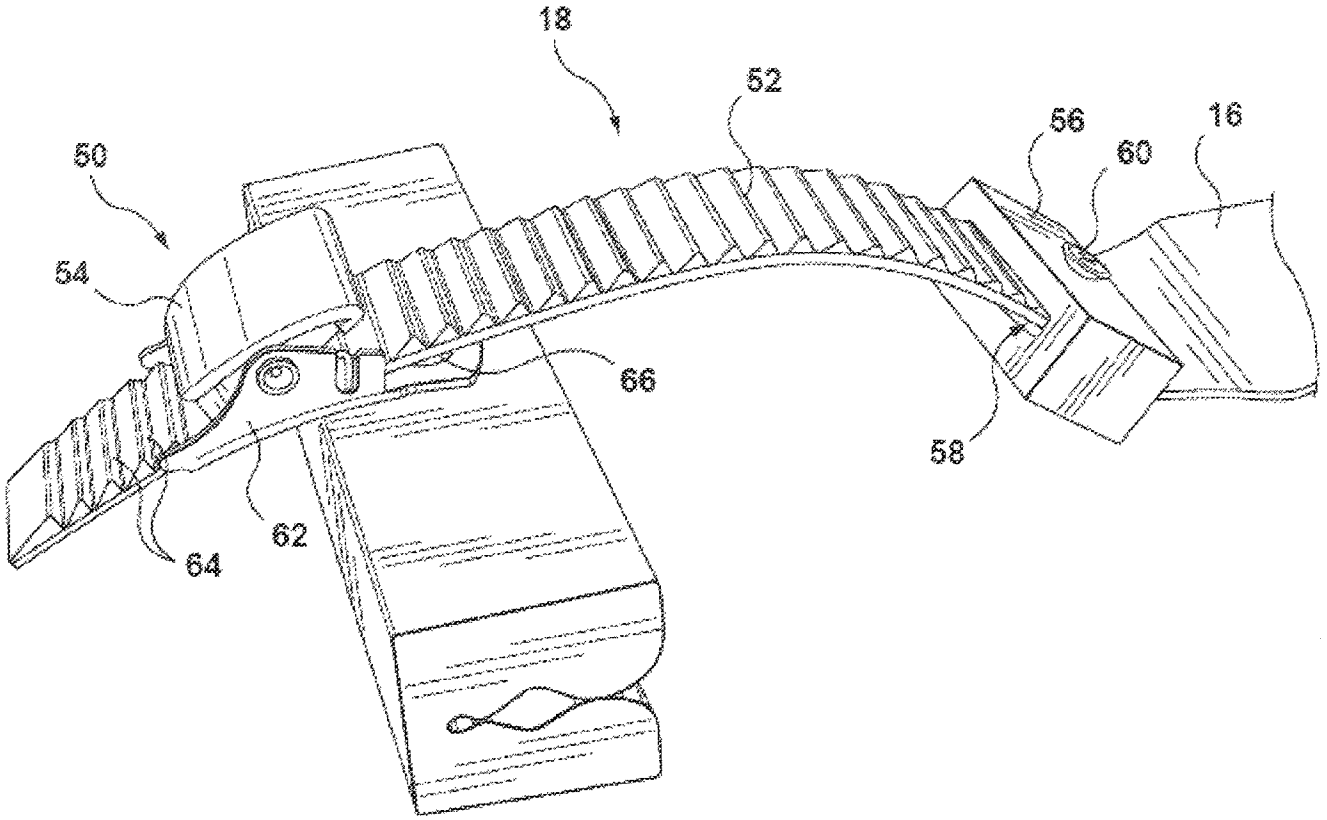
FIG. 4A is a perspective side view of the strap adjustment mechanism coupled to the club holder.

Referring now to FIG. 4A, the strap adjustment mechanism 18 is coupled to the flexible shoulder strap 16 for adjusting strap length. The strap adjustment mechanism 18 may include a quick release buckle 50 for adjusting strap length. In the illustrated embodiment, the quick release buckle 50 includes a ladder strap 52, and a ratcheting buckle 54 for releasable engaging the ladder strap 52. o The ladder strap 52 is coupled to the flexible shoulder strap 16. For example, a coupling block 56 may be used to secure the ladder strap 52 to the flexible shoulder strap 16. The coupling block 56 may have a slot 58 for receiving ends of both the ladder strap 52 and the flexible shoulder strap 16, and a screw 60 inserted through the coupling block 56 to secure everything together.

The ratcheting buckle 54 pivots about a buckle base 62 to selectively engage one of a plurality of rungs 64 along the ladder strap 52. Selectively engaging a particular rung 64 may provide a particular strap length. With reference to FIG. 3, the combined length of the two ladder straps 52 generally sets the range of adjustment between the minimum strap length 40 and maximum strap length 42 described previously.

While the illustrated embodiment shows two strap adjustment mechanisms 18, in other embodiments the golfing aid 10 may include one or more strap adjustment mechanisms 18.

In some embodiments, the strap adjustment mechanism 18 may be pivotally coupled to one or both of the club holder 12 and the flexible shoulder strap 16. For example, referring still to FIG. 4A, the buckle base 62 is pivotally coupled to the club holder 12 using a screw 66 or another type of fastener such as a rivet. This pivotal connection may allow use of the golfing aid 10 with a variety of golfers having different stances and club planes relative to their torso.

Figure 4B:
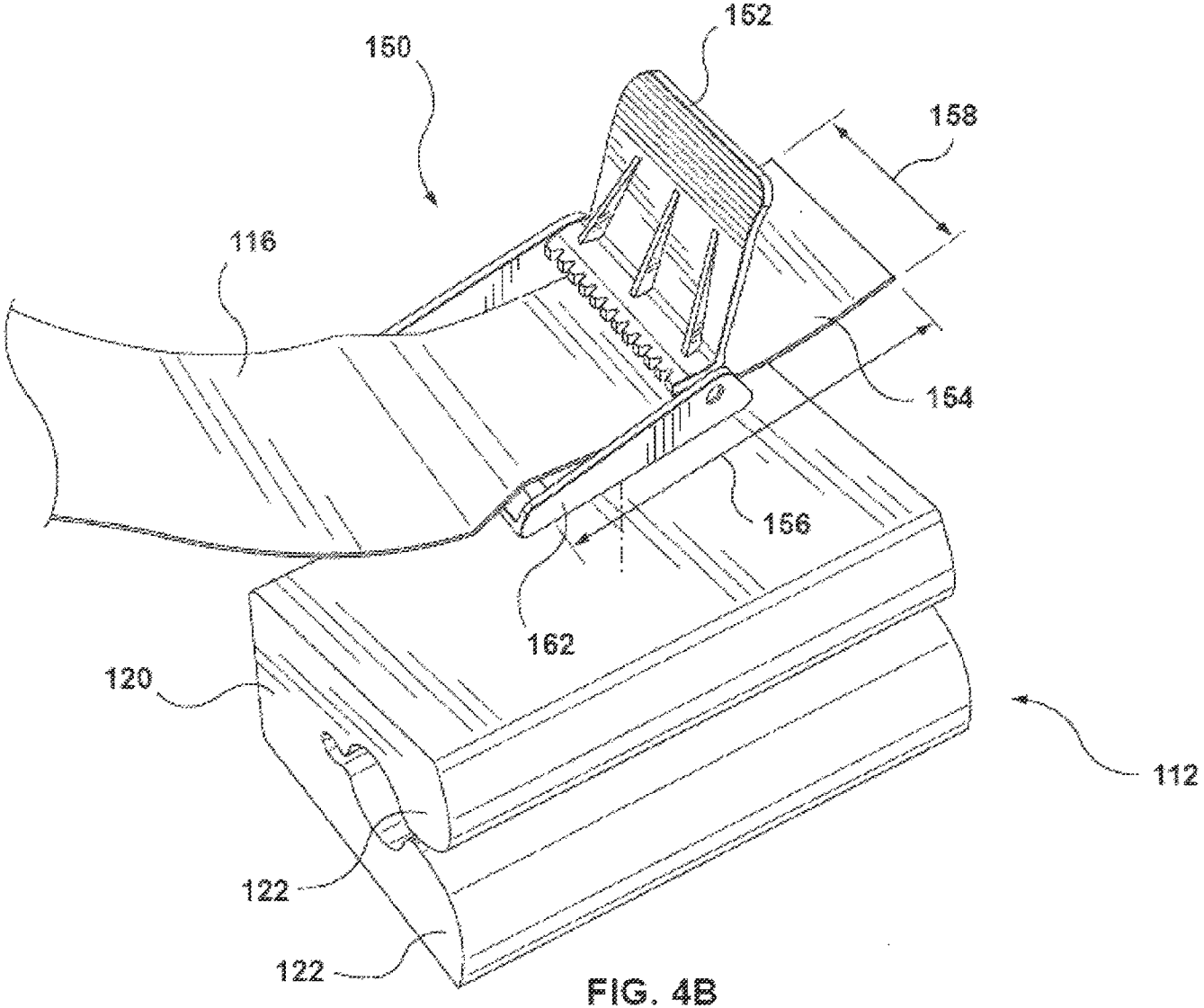
FIG. 4B is a perspective side view of another strap adjustment mechanism in accordance with another embodiment.
Figure 5:
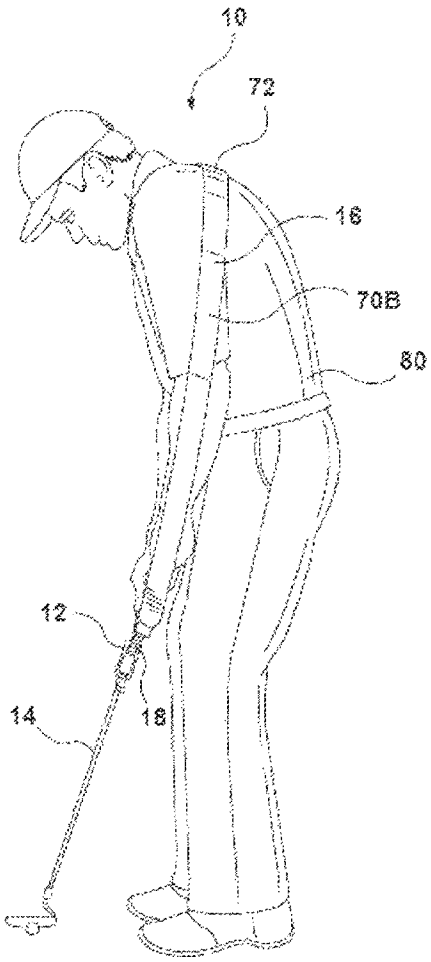
FIG. 5 is a side perspective view of the flexible shoulder strap being looped around the shoulders and upper arms of a golfer.
Figure 7:
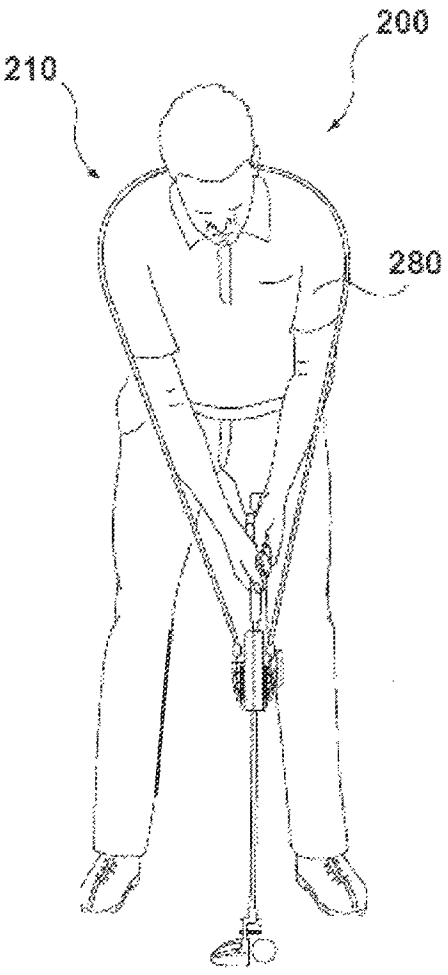
FIG. 7 is a front view of a golfer using a golf training aid.

In some embodiments, the strap adjustment mechanism 18 may have other configurations. For example, as shown in FIG. 4B, there is a quick release buckle 150 that includes a cam lock buckle 152 for releasable engaging an adjustable portion 154 of a flexible shoulder strap 116. The adjustable portion 154 has an adjustable length 156, which sets the range of adjustment between minimum and maximum strap lengths for the flexible shoulder strap 116. As shown, the adjustable portion 154 may have a reduced width 158 compared to the rest of the flexible shoulder strap 116. The reduced width 158 may be sized to fit through the cam lock buckle 152. For example, the flexible shoulder strap 116 may have a nominal width of 2.5-inches, and the reduced width 158 may be 2-inches (e.g. to fit within a 2-inch cam lock buckle).

In some embodiments, the flexible shoulder strap 116 may have a constant width along the entire strap length. For example, the flexible shoulder strap 116 may be 1-inch wide along the entire strap length (e.g. to fit within a 1-inch cam lock buckle).

The quick release buckle 150 also includes a buckle base 162 that is pivotally coupled to a club holder 112 (e.g. using a screw). As shown, the club holder 112 may have a base 120 and two club gripping arms 122. In this embodiment, the club gripping arms 122 have flat outer surfaces. The flat surfaces may facilitate attachment of the buckle base 162 to the club holder 112. This can be particularly helpful when the golfing aid is supplied as a user assembled kit. In this case, the end user assembles the golfing aid by screwing the buckle base 162 to the club holder 112, and then inserts the adjustable portion 154 of the flexible shoulder strap 116 through a slot between the buckle base 162 and the cam lock buckle 152. In some embodiments, the user may apply an adhesive such as double-sided tape between the buckle base 162 and the club holder 112.

In some embodiments, the strap adjustment mechanism may have other configurations such as belt buckles, Velcro™ hook and loop fasteners, snaps, buttons, clasps, and the like. In yet other embodiments, the flexible shoulder strap could be directly attached to the club holder. In such cases, the flexible shoulder strap may have a single non-adjustable length, which may be set by the user, or during manufacturing.

Referring now to FIGS. 3 and 6, the flexible shoulder strap 16 is configured to press against upper arms of a golfer 80 while being looped behind the shoulders of the golfer 80. In particular, the flexible shoulder strap 16 includes arm engaging portions 70A, 70B for pressing against or otherwise engaging outer sides of the upper arms (e.g. lateral upper arms). As shown in FIG. 3, each arm engaging portion 70A, 70B may have an arm engaging width 76A, 76B that substantially covers most of the upper arm of the golfer (e.g. engaging the triceps of the golfer 80). In some embodiments, a golfer may use the flexible shoulder strap 16 so that the arm engaging portions 70A, 70B cover a portion of the upper arms (e.g. the area around the rotator cuff insertion point and/or deltoids), and then extend above or below a remaining portion of the upper arms.

In some embodiments, each arm engaging width 76A, 76B may be at least 2-inches wide, or more particularly, between 2-inches and 6-inches wide, or more particularly still, about 2.5-inches wide. As will be described in further detail below, having sufficient arm engaging widths 76A, 76B can allow the golfing aid 10 to provide tactile feedback regarding the golfer's technique when practicing a golf stroke.

As shown in FIG. 3, the arm engaging portions 70A, 70B may be separated by an intermediate back engaging portion 72, which may be placed behind the back and shoulders of the golfer 80 during use (e.g. covering the shoulder blades of the golfer 80).

In the illustrated embodiment, the arm engaging portions 70A, 70B are joined to the intermediate back engaging portion 72 and form a continuous width along the flexible shoulder strap 16. In particular, the width of the flexible shoulder strap 16 is generally constant across the left upper arm, the back, and the right upper arm of the golfer 80. In other embodiments, the intermediate back engaging portion 72 may be narrower or wider than the arm engaging portions 70A, 70B. In such embodiments, each arm engaging portion 70A, 70B may have an arm engaging length 74A, 74B that is at least 8-inches long, or more particularly, between about 8-inches and 20-inches long.

Figure 6B:
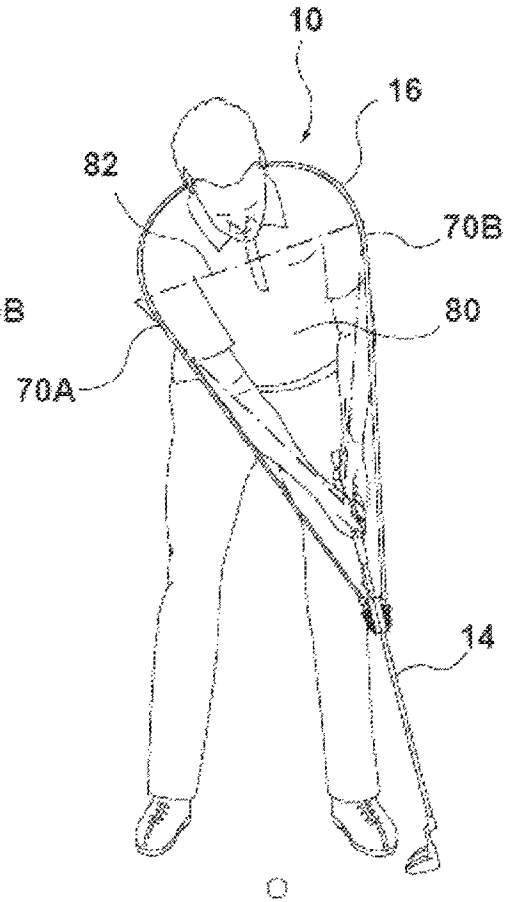
FIGS. 6A and 6B are front views of a golfer using the golfing aid.
Figure 6A:
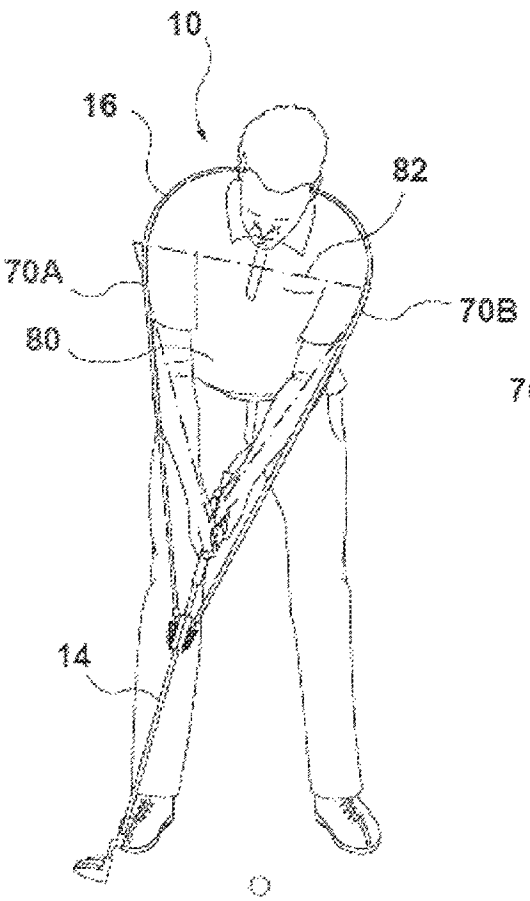

Referring now to FIGS. 6A and 6B, a method of training a golf stroke will now be described with reference to the golfing aid 10. In use, a golfer 80 inserts the golf club shaft 14 into the club holder 12. For example, the golf club shaft 14 may be placed in the club holder 12 so that the club holder 12 is adjacent to the hand grip of the golf club. The golfer 80 then places the flexible shoulder strap 16 around their shoulders. The flexible shoulder strap 16 is positioned so that the arm engaging portions 70A, 70B press against the upper arms of the golfer 80 (e.g. to cover the triceps). The golfer 80 grips the hand grip of the golf club shaft 14 and sets a desired strap length using the strap adjustment mechanism 18. In general, the strap length is set so that the flexible shoulder strap 16 is pulled taut against the shoulders while the golfer 80 grips the hand grip as they would during a typical golf swing. The golfer 80 can then practice their golf stroke by using their shoulders to swing the golf club such that the flexible shoulder strap 16 remains taut and presses against the shoulders and upper arms of the golfer 80.

In use, the golfing aid 10 may help establish a triangular frame 82 between the shoulders, arms and hands of the golfer 80. This triangular frame 82 encourages the golfer to use his or her shoulders and torso to drive the golf stroke in a one piece connected pendulum manner. Furthermore, the triangular frame 82 can help inhibit or reduce movement of other body parts that might interfere with a repeatable golf swing. For example, movement of the golfer's head, wrists, elbows or other body parts might introduce extra movements into the golf swing that could reduce consistency of a particular stroke.

In some cases, the golfing aid 10 may help provide feedback to help the golfer identify when undesired movements are being made. For example, if the golfer flicks his or her wrists forward or backward during a stroke, the golfer may feel a change in tension through the flexible shoulder strap 16. Specifically, the arm engaging portions 70A, 70B may break contact with the upper arms when the golfer flicks his or her wrist. Similarly, when the golfer pulls his or her head up or down, there may be a noticeable change in tension throughout the flexible shoulder strap 16. These changes in tension can help the golfer identify when he/she is not maintaining the triangular frame 82 throughout the golf stroke.

When practicing putting strokes, the golfer may hold the golf club shaft 14 squarely with both hands straight. In contrast, when practicing chipping strokes, he or she could lift and shift the flexible shoulder strap 16 in order to position their hands slightly ahead of the club face. This is a common correct position for chipping. Alternatively, they may adjust and shorten one side of the shoulder strap to accomplish a similar result. This may require one side of the flexible shoulder strap 16 to be lengthened, while the other side is shortened.

When practicing both the putting stroke and the chipping stroke, the golfing aid 10 can help maintain a triangular frame 82. This triangle frame may help a golfer perform a putting stroke driven by the shoulders in a one-piece pendulum movement without use of the hands or arms. This can help a golfer train and develop a repeatable golf swing. In some cases, training for 5-minutes to 10-minutes each day may help imprint a consistent golf stroke to muscle memory.

Figure 8:
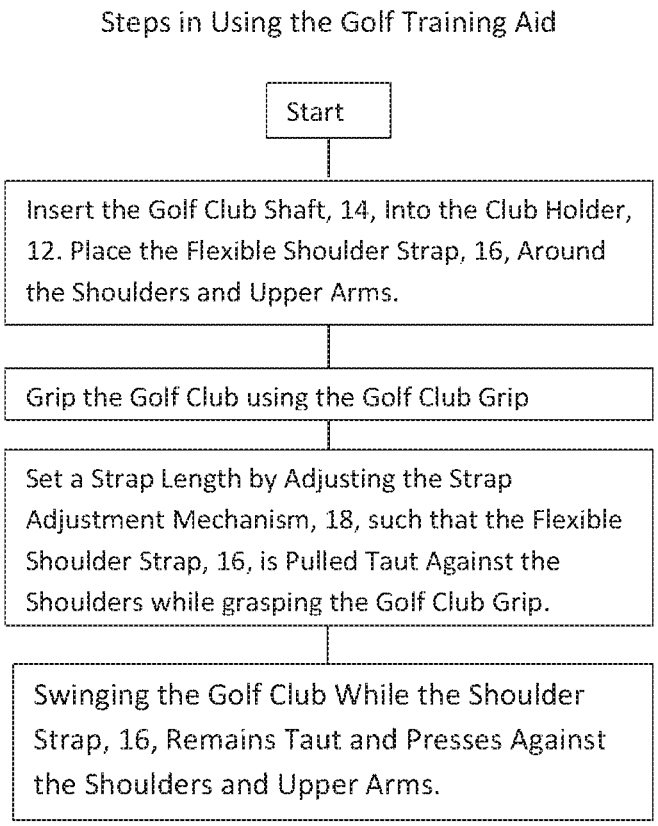
FIG. 8 shows a flow chart indicating the actions involved in using the golf training aid.

FIG. 8 shows the steps required to properly use the golfing aid disclosed in the application.

Figure 9:
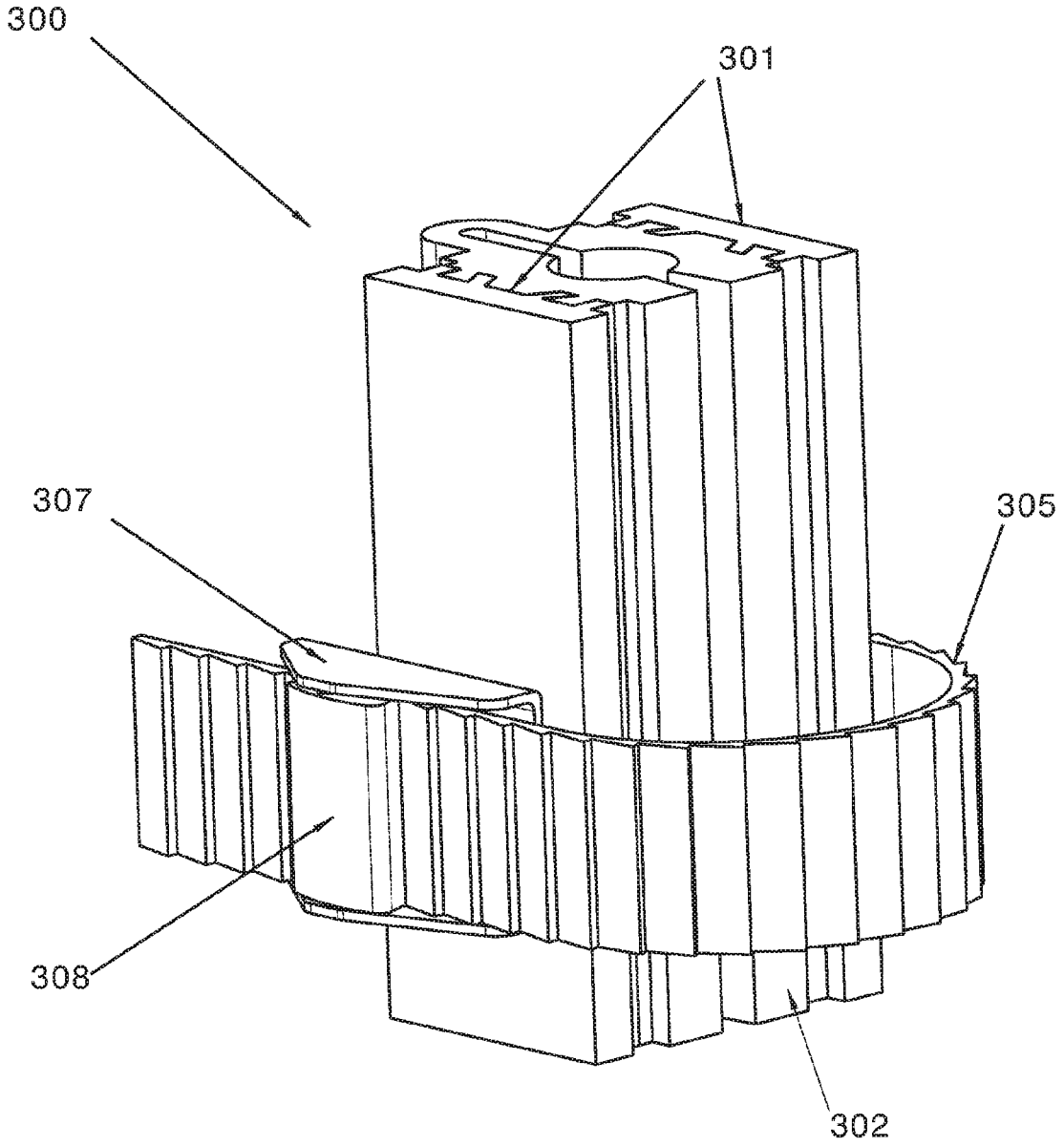
FIG. 9 shows a clamp actuated by a strap for clamping on the shaft of a golf club.

Referring to FIG. 9, an alternate club holder 300 is shown. The alternate club holder 300 has an inner core 302 made of a compressible material such as rubber or plastic with outer surfaces 301 made of a harder material such as plastic, aluminium. etc. The inner core 302 has a circular interior section that will accommodate golf club shafts. The club holder 300 has an external strap 305 that passes through a metal or plastic clip 307 where it is engaged by a ratchet mechanism toggle 308 which can be released through activating the toggle 308. The strap 305 can be made of plastic or other flexible materials. The external strap 305, the clip 307, and the toggle 308 are shown as being based on a one way ratchet mechanism; however, a friction type mechanism or other type of releasable strap mechanism could also be used.

Figure 10:
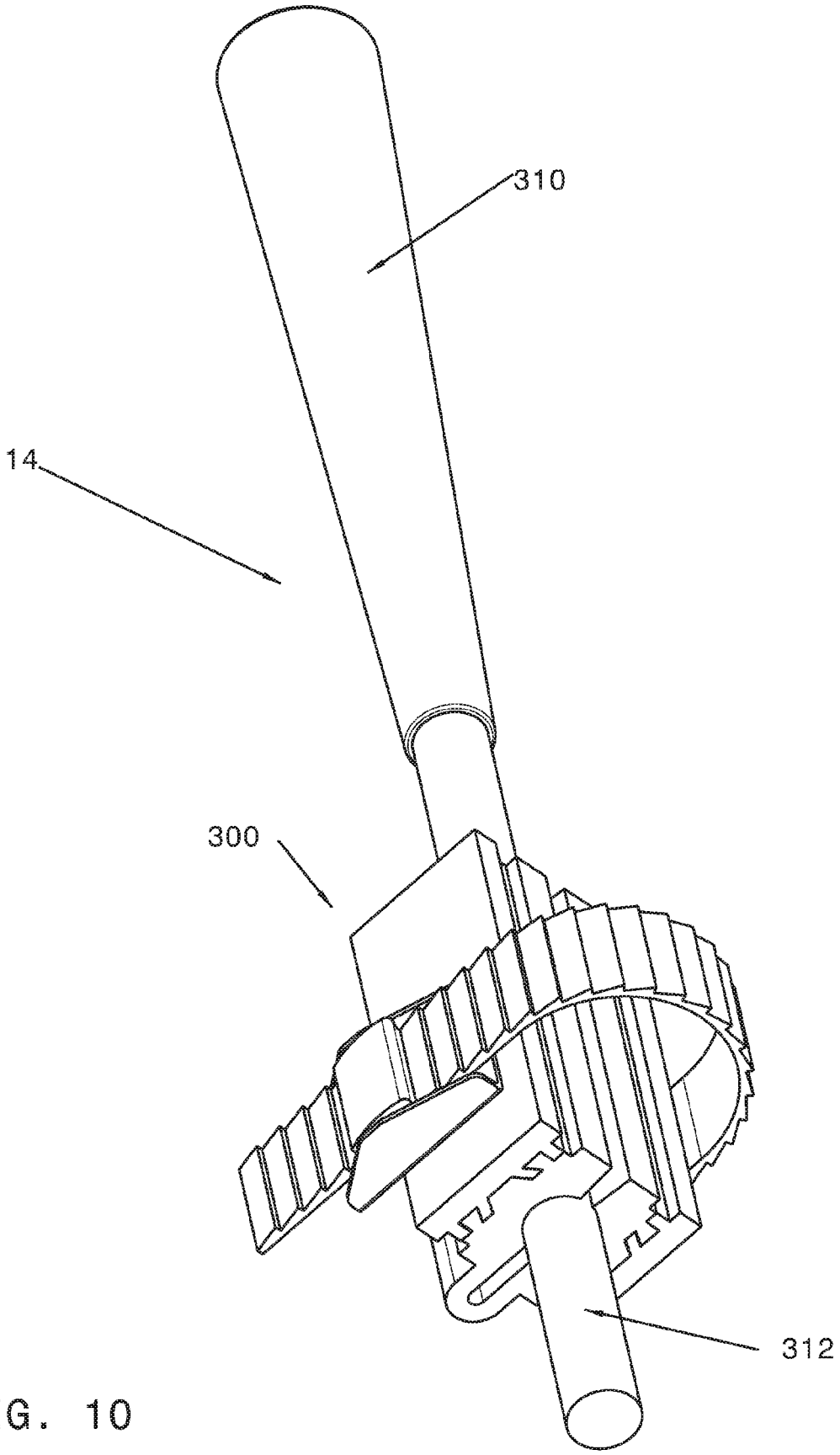
FIG. 10 shows the clamp of FIG. 9 clamped on the shaft of a golf club, below the grip of the golf club.

Referring to FIG. 10, the alternate club holder 300 from FIG. 9 is shown mounted on a golf club shaft 312 below the grip 310 of the golf club 14. The engagement of the alternate club holder on the shaft 312 of the golf club 14 is clearly shown in this figure.

Figure 11:
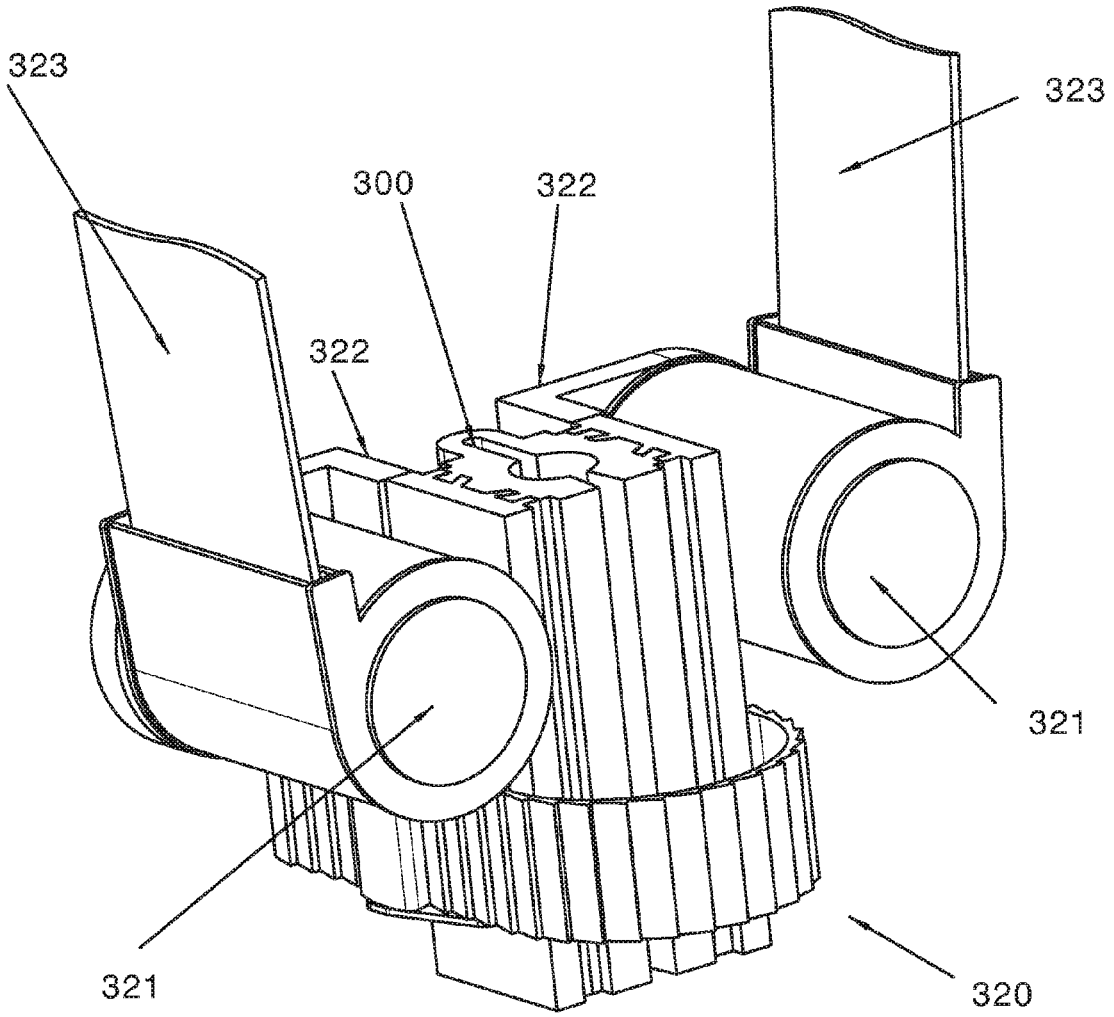
FIG. 11 shows the clamp of FIG. 9 with strap tensioning reels attached.

Referring to FIG. 11, an assembly 320 is shown that provides a connection between the alternate club holder 300 and the shoulder strap 323. Two brackets 322 are attached to the alternate club holder 300 and attached to these brackets are two take-up-reels 321 which each have one end of the shoulder strap 323 attached to them. This assembly 320 allows the shoulder strap 323 to automatically adjust for different size users of the training aid. A further advantage of this assembly 320 is that even if the shoulder strap 323 is not properly centered over the shoulders of the user the two-take-up reels 321, will individually adjust to keep the shoulder strap 323 equally tensioned on both sides of the assembly 320.

Figure 12:
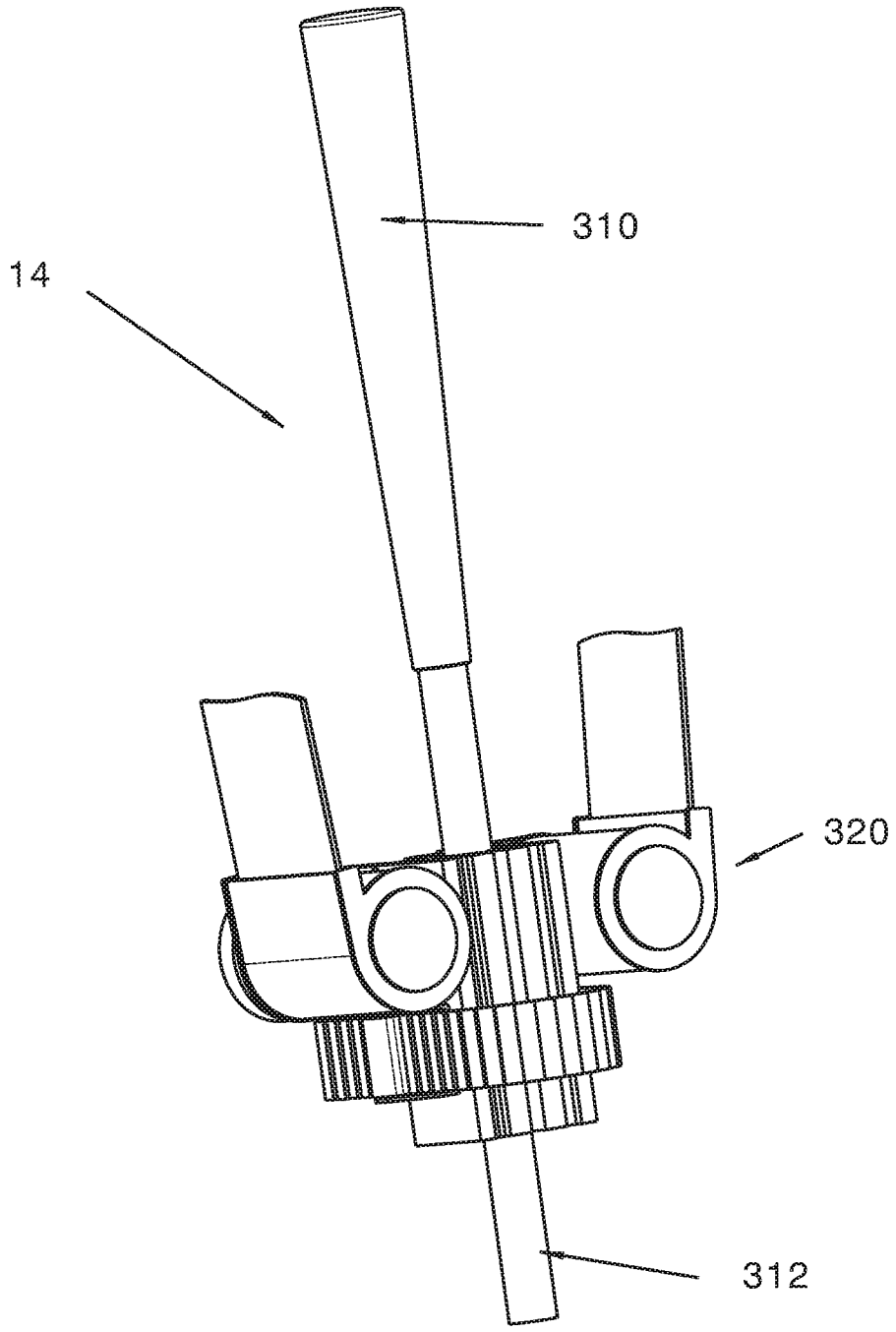
FIG. 12 shows the clamp with tensioning reels of FIG. 11 clamped on the shaft of a golf club below the grip of the golf club.

Referring to FIG. 12, the assembly 320 is shown mounted on a golf club 14 by clamping to the golf club shaft 312 below the grip 310.

Figure 13:
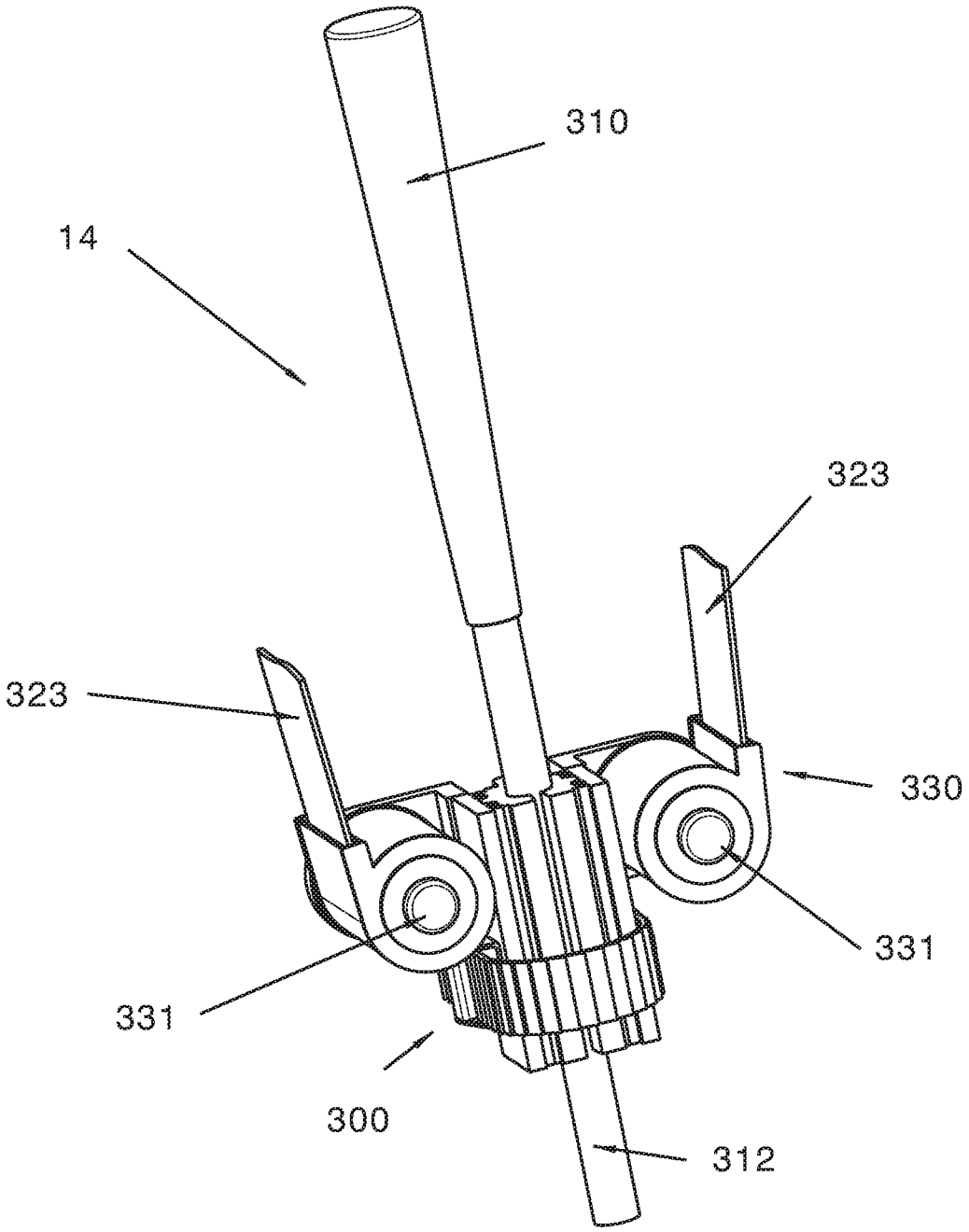
FIG. 13 shows a clamp actuated by a strap with locking strap tensioning reels clamped on the shaft of a golf club below the hand grip of the golf club.

Referring to FIG. 13, an additional version 330 of the take-up-reel concept introduced in FIG. 11 is shown. In this version 330 the take-up-reels are shown with lock/unlock buttons 331 that can provide a fixed length of the shoulder strap 323. The advantage of this version 330 of the assembly is that once the reels are locked using the buttons 331 a very rigid structure is formed by the shoulder strap in conjunction with the user's body. Also shown in FIG. 13 is the golf club 14.

Figure 14:
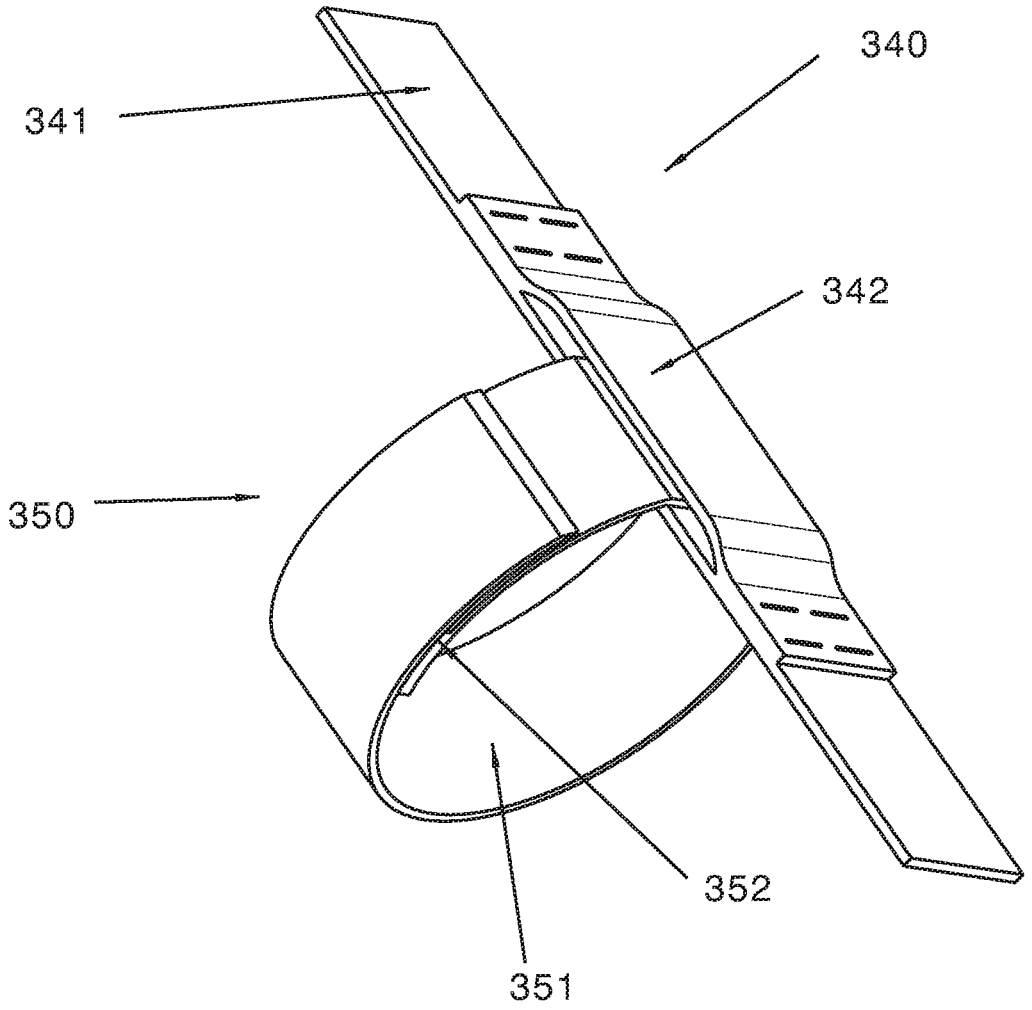
FIG. 14 shows an adjustable arm band attached to the strap.

Referring to FIG. 14, the shoulder strap 341 (only one side is shown) has an arm band 351 attached forming an adaptation 340 of the basic shoulder strap arrangement as has been previously shown. The attachment of the arm band 351 is shown as being done by attaching an additional piece of strapping 342 by stitching to the shoulder strap 341. The arm band 351 is shown as closing around the user's arm through the use of Velcro 352 between the two overlapping ends of the arm band 351. It is understood that other closing methods for the armband 351 are also possible such as a buckle or friction engagement mechanism. The use of 2 arm bands 351 one on each arm the user will help to hold the shoulder strap 341 firmly in position on the user.

Figure 15:
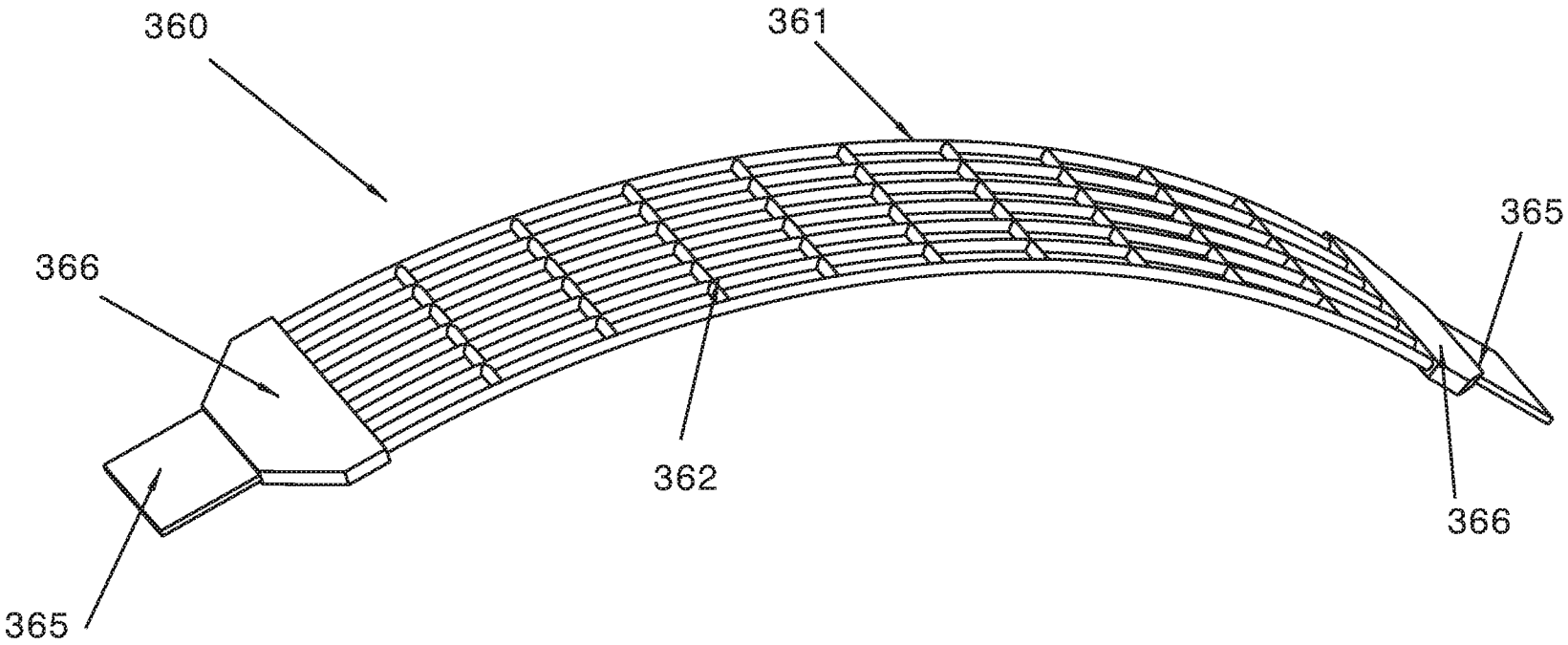
FIG. 15 shows a net type strap that can engage the shoulders of the golfer.

FIG. 15 shows an additional version of the shoulder strap 360, wherein the upper portion of the shoulder strap 360 that sits on top of the user's shoulders is made from netting 361 with cross straps 362. The netting 361 is attached to the web portion of the shoulder strap 365 thru the use of a connector 366 which allows the netting 366 to be wider that the shoulder strap 365. The advantage provided by the additional version of the shoulder strap 360 is that the netting 361 with its cross straps 362 can be spread over the user's shoulders providing a greater contact area and therefore better adhesion with the shoulders of the user.

Figure 16:
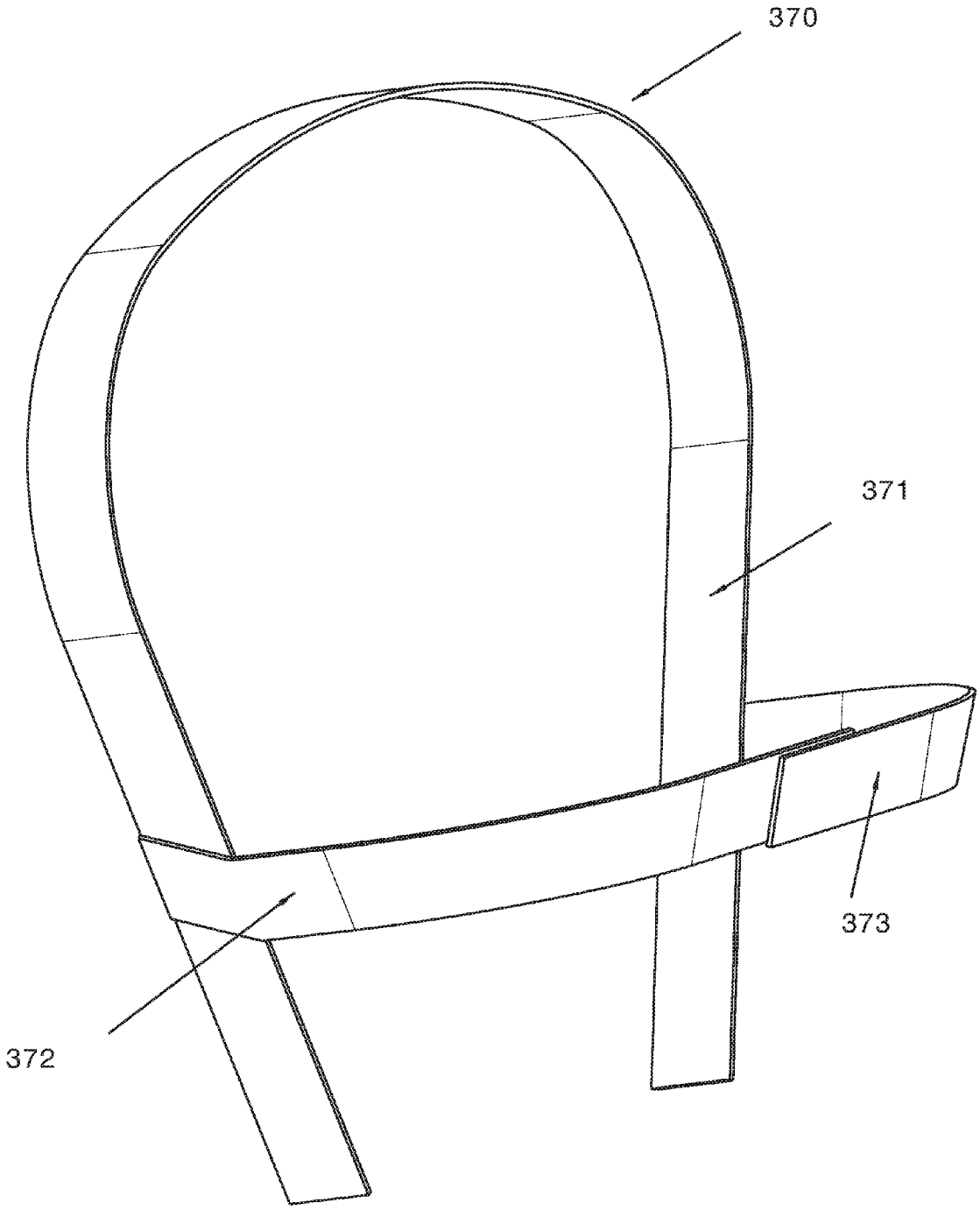
FIG. 16 shows a strap with cross straps that can be tensioned across the chest of the golfer.

FIG. 16 shows a further version of the shoulder strap system 370. In this case the shoulder strap 371 is cross connected in front of the user thru additional straps 372 and 373 that cross over the chest of the user. The two straps 372 and 373 can be connected thru the use of Velcro or other attachment means across the chest of the user. The presence of the additional straps 372 and 373 serve to securely hold the shoulder strap in place on the user's body.

Figure 17:
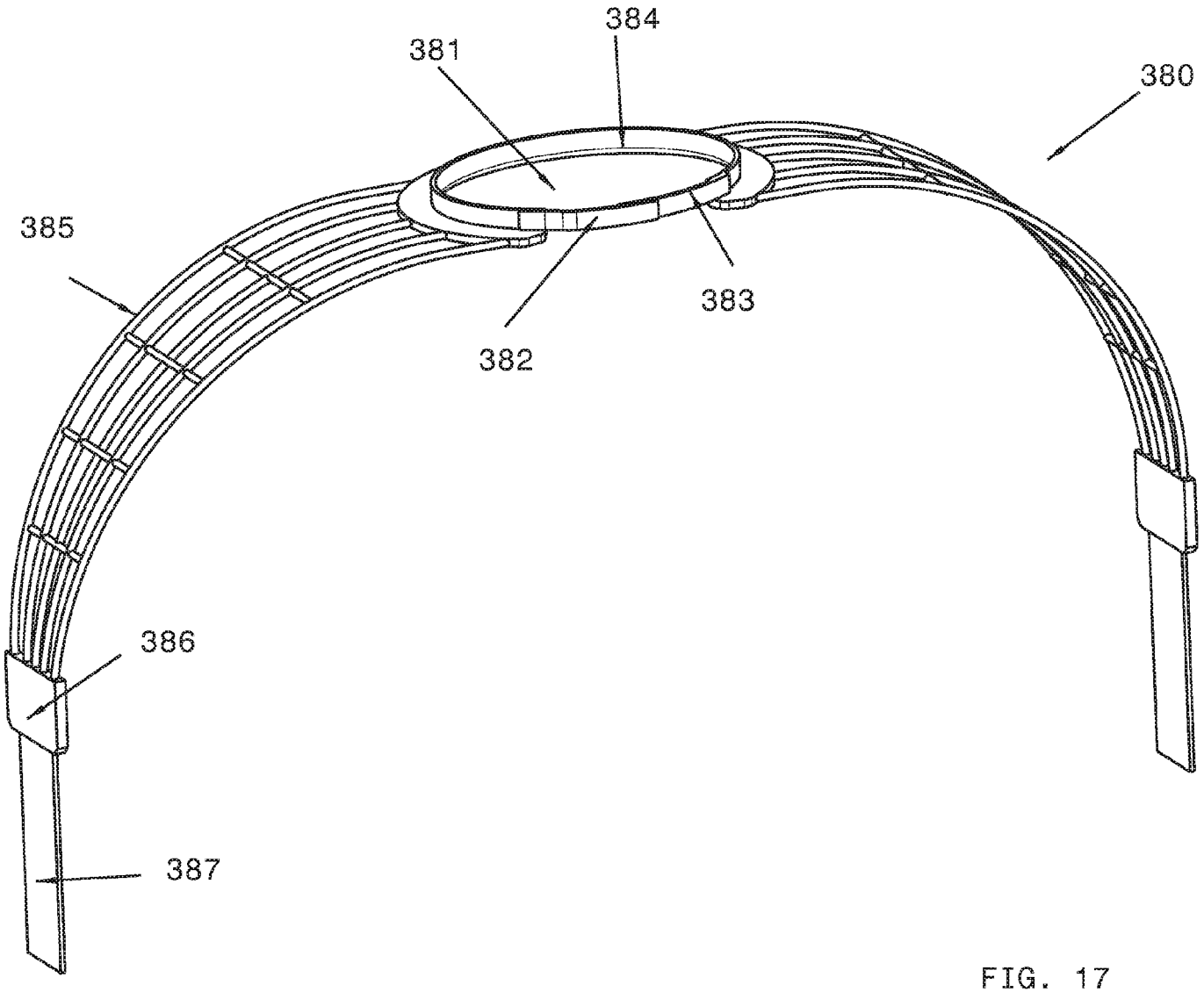
FIG. 17 shows a strap with a neck hole that can be closed with straps, also having a net type structure to engage the shoulders of the golfer.

FIG. 17 shows another possible version of the shoulder strap system 380 wherein there is a hole 381 formed by a ring 384 that is placed around the user's neck. The tightness of the ring 384 can be adjusted using the two straps 382 and 383 that connect with each other using Velcro or some other attachment means. The ring 384 is connected thru netting 385 that lies on the user's shoulders to the shoulder strap webbing 387 through the connector 386. The connector 386 allows the width of the netting 385 to be wider than the webbing 387 of the shoulder strap. The advantages of this shoulder strap system 380 are that it can contact on both the front and the rear of the user's shoulder and it also is stabilized by the user's neck, both of these features provide improved stability of the shoulder strap system 380 on the user's body.

While the above description provides examples of one or more apparatus, methods, or systems, it will be appreciated that other apparatus, methods, or systems may be within the scope of the claims as interpreted by one of skill in the art.

The invention claimed is:

1. A golfing aid comprising:

a) a club holder for realisably holding a golf club by gripping the shaft below the hand grip of the golf club;

b) a single inextensible flexible shoulder strap having two ends coupled to the club holder, the flexible shoulder strap being sized and shaped to loop behind shoulders of a golfer and press against the upper arms of the golfer, the flexible shoulder strap including arm engaging portions for engaging outer sides of the upper arms and;

c) two reel type web retractors, wherein each reel type web retractor is attached to one end of the strap and the club holder is located between the two reel type web retractors.

2. The golfing aid of claim 1, wherein the reel type web retractors have lock/unlock mechanisms.

3. A golfing aid comprising:

a) a club holder for realisably holding a golf club by gripping the shaft below the hand grip of the golf club;

b) a single inextensible flexible shoulder strap having two ends coupled to the club holder, the flexible shoulder strap being sized and shaped to loop behind shoulders of a golfer and press against the upper arms of the golfer, the flexible shoulder strap including arm engaging portions for engaging outer sides of the upper arms and;

c) where the flexible shoulder strap has two arm bands attached to it that adjustably clamp around both of the upper arms of the golfer.

4. A golfing aid comprising:

a) a club holder for realisably holding a golf club by gripping the shaft below the hand grip of the golf club;

b) a single inextensible flexible shoulder strap having two ends coupled to the club holder, the flexible shoulder strap being sized and shaped to loop behind shoulders of a golfer and press against the upper arms of the golfer;

c) where the flexible shoulder strap has an additional portion, adjustable for size, that passes completely around the neck of the golfer.

* * * * *